US009644851B2

(12) United States Patent
Livchak et al.

(10) Patent No.: US 9,644,851 B2
(45) Date of Patent: May 9, 2017

(54) AUTOMATIC DISPLACEMENT VENTILATION SYSTEM WITH HEATING MODE

(76) Inventors: Andrey Livchak, Bowling Green, KY (US); Rick A. Bagwell, Scottsville, KY (US)

( * ) Notice: Subject to any disclaimer, the term of this patent is extended or adjusted under 35 U.S.C. 154(b) by 808 days.

(21) Appl. No.: 12/973,571

(22) Filed: Dec. 20, 2010

(65) Prior Publication Data

US 2011/0143648 A1 Jun. 16, 2011

Related U.S. Application Data

(63) Continuation of application No. 11/722,374, filed as application No. PCT/US2006/000587 on Jan. 6, 2006, now abandoned.

(60) Provisional application No. 60/593,350, filed on Jan. 6, 2005.

(51) Int. Cl.
*F24F 11/00* (2006.01)
*F24F 1/00* (2011.01)

(52) U.S. Cl.
CPC ..... *F24F 1/0059* (2013.01)

(58) Field of Classification Search
CPC ..... F24F 11/00
USPC ..... 454/239
See application file for complete search history.

(56) References Cited

U.S. PATENT DOCUMENTS 2,928,330 A 3/1960 Otto
4,522,255 A 6/1985 Baker
4,729,292 A * 3/1988 Marton ..... F24F 13/075 454/284
5,346,426 A 9/1994 Kronfalt
5,607,354 A * 3/1997 Mill ..... F24F 1/02 454/186
6,019,677 A * 2/2000 Demster ..... 454/290
6,033,303 A 3/2000 Green et al.
6,250,373 B1 * 6/2001 Vecchi et al. ..... 165/53
7,722,449 B2 * 5/2010 Nowak ..... F24F 13/082 454/270
7,832,220 B1 11/2010 Wiggs
7,889,516 B2 * 2/2011 McDowell ..... H04Q 1/06 361/826
8,066,558 B2 * 11/2011 Thomle ..... F24F 11/0001 454/256

(Continued)

FOREIGN PATENT DOCUMENTS

DE 40 07 418 A1 9/1991
DE 10157115 4/2003

(Continued)

OTHER PUBLICATIONS

International Search Report for International Application No. PCT/US2006/000587 dated May 10, 2006.

(Continued)

*Primary Examiner* — Steven B McAllister
*Assistant Examiner* — Samantha Miller
(74) *Attorney, Agent, or Firm* — Potomac Law Group, PLLC; Mark Catan

(57) ABSTRACT

Displacement ventilation systems are generally poor performers when it comes to heating. The instant patent application discusses devices and systems for improving heating performance while retaining the benefits of displacement ventilation without wholesale co-location of independent space conditioning systems.

14 Claims, 9 Drawing Sheets

(56) References Cited

U.S. PATENT DOCUMENTS

| | | | | |
|---|---|---|---|---|
| 8,483,883 | B1 * | 7/2013 | Watson | F24F 3/044 236/49.3 |
| 8,511,022 | B2 * | 8/2013 | Curtin | E04F 15/02405 52/302.1 |
| 8,641,492 | B2 * | 2/2014 | Meyer | H05K 7/20745 454/184 |
| 8,733,060 | B2 * | 5/2014 | Curtin | E04F 15/02405 454/299 |
| 9,127,854 | B2 * | 9/2015 | Briar | F24F 13/14 |
| 9,148,981 | B2 * | 9/2015 | Beck | H05K 7/20745 |
| 2001/0003902 | A1 | 6/2001 | Kopko | |
| 2001/0029164 | A1 | 10/2001 | Fikes | |
| 2003/0021720 | A1 | 1/2003 | Reisfeld et al. | |

FOREIGN PATENT DOCUMENTS

| | | | |
|---|---|---|---|
| EP | 0399935 | A1 | 11/1990 |
| EP | 046669 | | 1/1992 |
| EP | 1 323 988 | A | 7/2003 |

OTHER PUBLICATIONS

International Search Report for International Application No. PCT/US05/017793 dated Mar. 13, 2006.
Office Action dated Aug. 18, 2011 in U.S. Appl. No. 11/722,374.
International Preliminary Report on Patentability in International Application No. PCT/US2006/000587 dated Jul. 10, 2007.
Written Opinion in International Application No. PCT/US2006/000587 dated Jul. 6, 2007.
Communication with European Search Report dated Nov. 12, 2007 in European Application No. EP 07115479.3.
Advisory Action in U.S. Appl. No. 11/722,374 dated Aug. 23, 2010.
Final Office Action in U.S. Appl. No. 11/722,374 dated Apr. 30, 2010.
Non-Final Office Action in U.S. Appl. No. 11/722,374 dated Oct. 7, 2009.
Final Office Action dated Apr. 5, 2012 in U.S. Appl. No. 11/722,374.
Canadian Office Action dated Mar. 9, 2012 in corresponding Canadian Application No. 2,593,244.

* cited by examiner

AUTOMATIC DISPLACEMENT VENTILATION SYSTEM WITH HEATING MODE

CROSS-REFERENCE TO RELATED APPLICATIONS

This application is a continuation of application Ser. No. 11/722,374 filed Dec. 28, 2007 now abandoned, which is a 371 national stage entry of International Application No. PCT/US2006/000587 filed Jan. 6, 2006, which claims priority to International Application No. PCT/US2005/017793 filed May 19, 2005, which claims the benefit of U.S. Provisional Application No. 60/593,350 filed Jan. 6, 2005. The entire content of each of the foregoing applications is hereby incorporated by reference into the present application.

These figures are intended to show the concept and are not intended to show details of components whose designs are well understood in the field such as linkages, motor, details, bearings, supports, etc. These are within the competence of skilled practitioners and are not discussed in detail herein.

DETAILED DESCRIPTION OF THE DRAWINGS

Figure 1A:
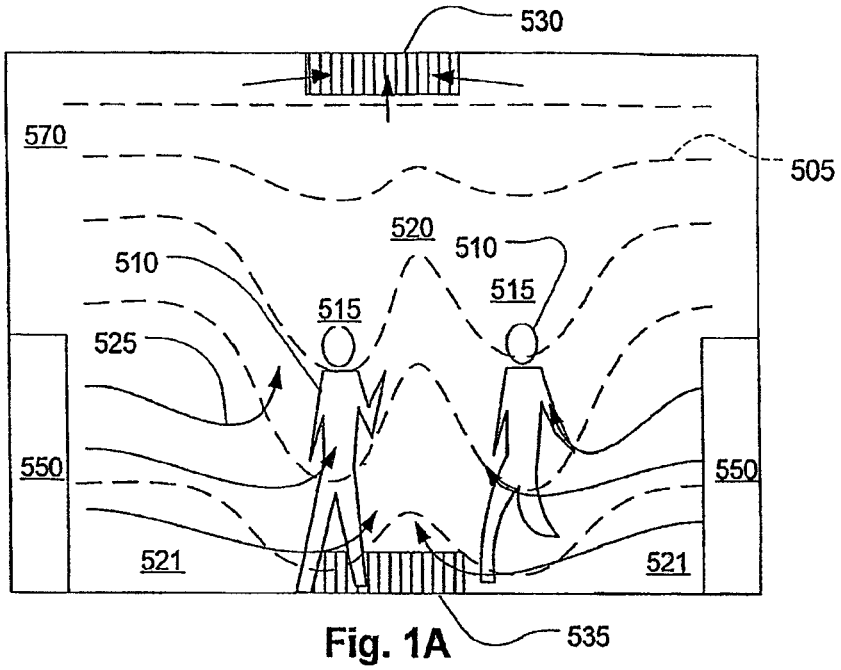
FIGS. 1A and 1B illustrates a conditioned space with configurable mixing/displacement ventilation registers in displacement and mixing modes, respectively.
Figure 1B:
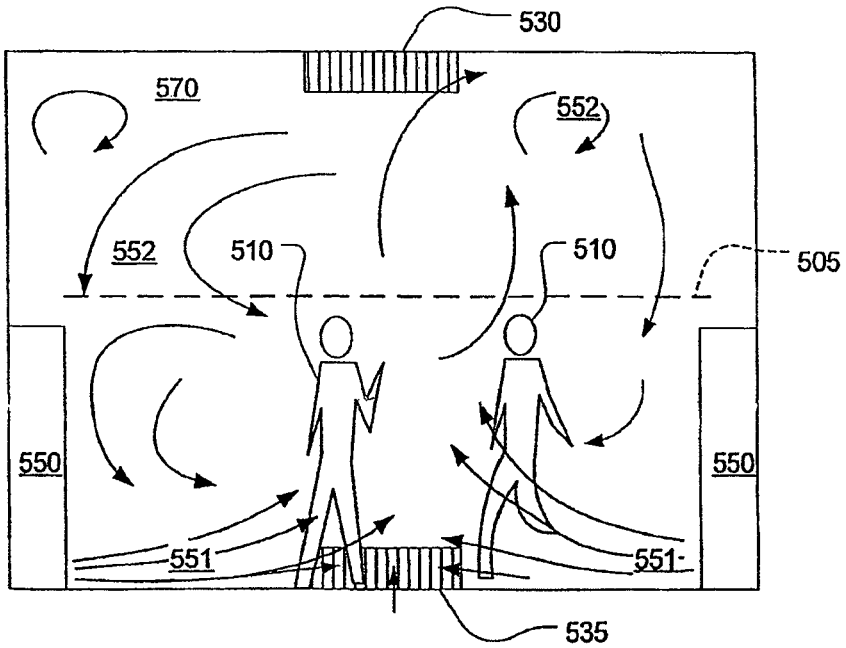

FIG. 1A and FIG. 1B illustrates a configurable mixing/displacement ventilation register 550 in an occupied room 570. People 510 in the room are warmer than the surrounding air, causing air to rise by convection. The room also contains a cooling-mode return register 530 in the upper portion of the room, and a heating mode return register 535 in the lower portion of the room. The temperature of the air within the room 570 is illustrated by isothermal layers of constant temperature air 505.

When the room is in displacement mode, which is generally used for cooling the conditioned space, the mixing/displacement ventilation register 550 supplies cooled air at a low velocity from a relatively high portion and over a relatively large face area of the mixing/displacement ventilation register 550. This cool air flows along the lower portion of the room. Any heat source within the room such as the occupants 510, causes air warmed by that source to rise by convective forces resulting in warm zones indicated by dips in contours of constant temperature 515. This rising air draws fresh cool air pooled near a floor 521 to replace the polluted and stale air surrounding the occupants 510. The warm air pools near the ceiling and is withdrawn by the return register 530. The higher regions of the room 570 remain relatively undisturbed and since it is not within the lower part of the room—the inhabited space—the air in contact with and breathed by occupants is relatively fresh. By not cooling this uninhabited space, the cooling efficiency is increased. Also, the immediate replacement of air polluted by heat sources increases comfort.

FIG. 1B illustrates the mixing mode for heating the occupied space. In this mode, the mixing/displacement ventilation register 550 supplies heated air at a high velocity through a relatively small face area as illustrated by jets 551. This warm air flows rapidly along the lower portion of the room before it has time to rise from convection and encourages mixing of all the air in the room, as indicated by the randomly arranged and directed arrows 552. This rapid movement causes mixing of the air in the room due to the initial velocity of the jets 551, their turbulence, and the tendency of the heated air naturally to rise due to convection. The heating mode return register 535 removes cooled air which tends to sink from convection.

Figure 2A:
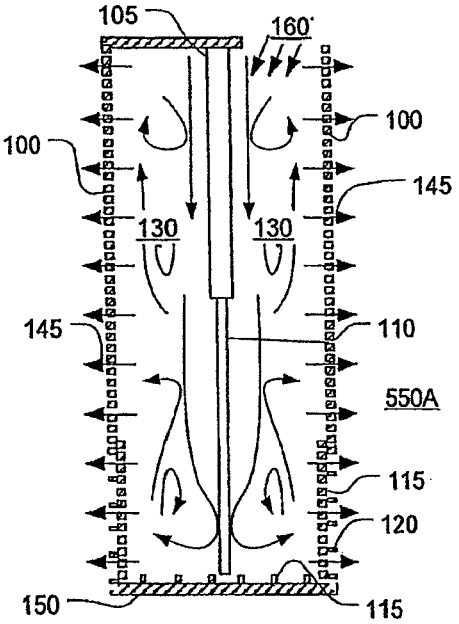
FIGS. 2A and 2B illustrate a first embodiment of a configurable mixing/displacement ventilation register in displacement and mixing modes, respectively.
Figure 2B:
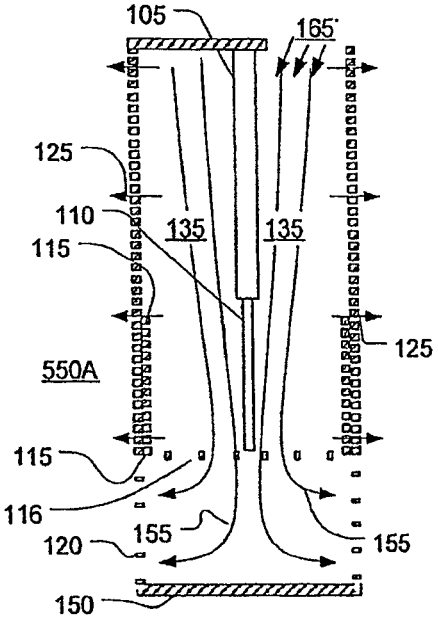

FIGS. 2A and 2B illustrate a first embodiment of a configurable mixing/displacement ventilation register 550 in displacement and mixing modes, respectively. Referring now to FIG. 2A the first embodiment of a configurable mixing/displacement ventilation register 550 is in displacement, or cooling, mode. As the cool air 160 enters the ventilation register plenum 130 it causes a thermal actuator 105 to move a thrust rod 110 attached to a baffle cage 115 toward a lower section 120 of the configurable mixing/displacement ventilation register 550, thereby moving it to the floor base 150 of the configurable mixing/displacement ventilation register 550. The baffle cage 115 allows air to pass through it and serves to spread the flow over the large face area that includes a larger baffle housing 100 of the configurable mixing/displacement ventilation register 550. The open area of the baffles 100 and 115 is such as to cause resistance across the face of the baffles 100 and 115 thereby spreading the incoming flow 160 broadly over the face area of the baffles 110 and 115. This results in flow over the majority of the outer diffusion baffle 100 of the configurable mixing/displacement ventilation register 550 as indicated by arrows 145. The air flowing from the baffle cage 115 and the baffle housing 110 therefore functions as displacement supply register venting air at a low velocity through relatively restrictive openings in the baffles of the baffle housing 100 and the baffle cage 115.

FIG. 2B illustrates the first embodiment in mixing, or heating, mode. As the warm air 165 enters the ventilation register plenum 135 it causes thermal actuator 105 to move the baffle cage 115 upwardly to uncover an open outlet 120 of the configurable mixing/displacement ventilation register 550. A bottom 116 of the baffle cage 115 has a high percentage open area and provides little resistance to flow as does the open outlet 120. As a result, a direct flow path through the plenum 135 to the open outlet 120 is created which results in low restriction—high velocity—flow of the warm air to the open outlet 120. Thus, most of the heating air 165 passes at a relatively high velocity out the lower, relatively small face area of the open outlet 120 of the configurable mixing/displacement ventilation register 550. Thus, in the present configuration, it functions as a mixing supply register.

Figure 3A:
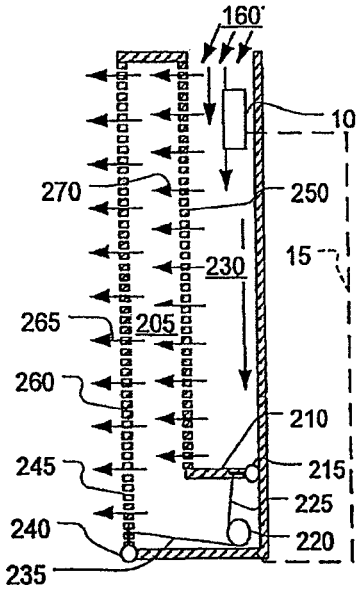
FIGS. 3A and 3B illustrate a second embodiment of a configurable mixing/displacement ventilation register in displacement and mixing modes, respectively.
Figure 3B:
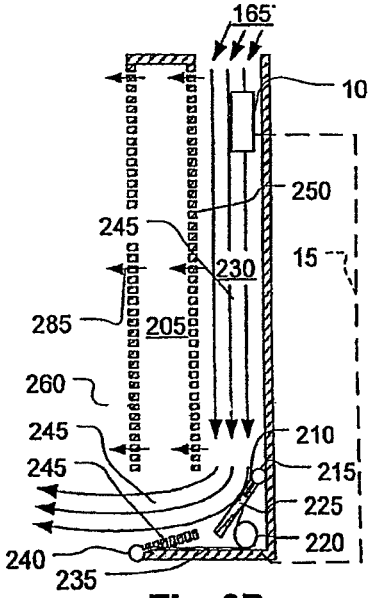

FIGS. 3A and 3B illustrate a second embodiment of a configurable mixing/displacement ventilation register in displacement and mixing modes, respectively. FIG. 3A illustrates the second embodiment of the configurable mixing/displacement ventilation register 551 in displacement, or cooling mode. A transmission 15 is indicated figuratively by a broken line. The transmission may be formed by any suitable means such as a pulley or gear system or by means of pushing or pulling or other rotating members. The details are outside the scope of invention and are readily created for various design arrangements.

As cool air 160 enters a ventilation register plenum 230 it causes the thermal actuator 10, by way of the transmission 15, to rotate a spring loaded capstan 220 which releases tension on a chord 225 allowing a spring-loaded cap plate 210 to pivot on an axis of the capstan/lever 215 to seal the end 212 of the ventilation register plenum 230. Cool air flow 270 is forced to spread the flow over the large face area of a flow-restricting baffle 250 and further distributed by an outer baffle 260. The capstan 220 also releases tension on a lower pull cord 235 releasing a spring loaded baffle panel 245 to pivot on a spring-loaded axel 240, securing it flush with the outer baffle 260 of the configurable mixing/displacement ventilation register 551.

Note that the transmission 15 and the pulley and capstan components are shown for illustration purposes only and can be replaced by any suitable mechanism for performing the described functions. These mechanisms could be mechanical or electromechanical and performed by means of a thermoactuator such as a wax motor or a linear actuator powered by electricity or pneumatic power or controls. There are many possible design variations and the details are unimportant for understanding the invention so they are not discussed at length here. Note also that the views of the present, foregoing, and further embodiments below are section views of suitable enclosures. They can be rectangular or other shapes. The materials used may be any combination of metal, plastic, or other materials suitable for conveying air.

The resulting configuration illustrated in FIG. 3A allows the cool air 165 to flow through the outer baffle 260 of the configurable mixing/displacement ventilation register 551 in the manner of a displacement supply register. The open area of the baffle 260 is such as to cause resistance across the face of the baffle 260 and the baffle panel 245 thereby spreading the flow 160 broadly over the outer baffle 260 face area of the configurable mixing/displacement ventilation register 551 as indicated by arrows 265. It therefore functions as displacement supply register, venting air at a low velocity through relatively restrictive openings of the outer baffle 260 and the baffle panel 245.

FIG. 3B illustrates the second embodiment of the configurable mixing/displacement ventilation register 551 in mixing, or heating mode. As the heated air 165 enters the ventilation register plenum 230 it causes the thermal actuator 10 to act through the transmission 15 to rotate the spring-loaded capstan 220, exerting tension on the cap plate pull cord 225 causing the spring-loaded cap plate 210 to pivot on the axel 215 and open the end 212 of the plenum 230. The capstan 220 also exerts tension on the lower pull cord 235 causing the spring loaded baffle panel 245 to pivot on the axis 240, opening the lower portion of the configurable mixing/displacement ventilation register 551. As a result, most of the heated air 165 passes at a relatively high velocity out the lower, relatively small face area of an open outlet 243 of the configurable mixing/displacement ventilation register 551 so that it functions as a mixing supply register.

Figure 4A:
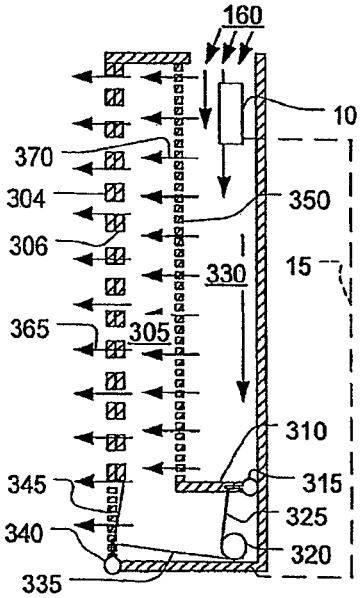
FIGS. 4A and 4B illustrate a third embodiment of a configurable mixing/displacement ventilation register in displacement and mixing modes, respectively.
Figure 4B:
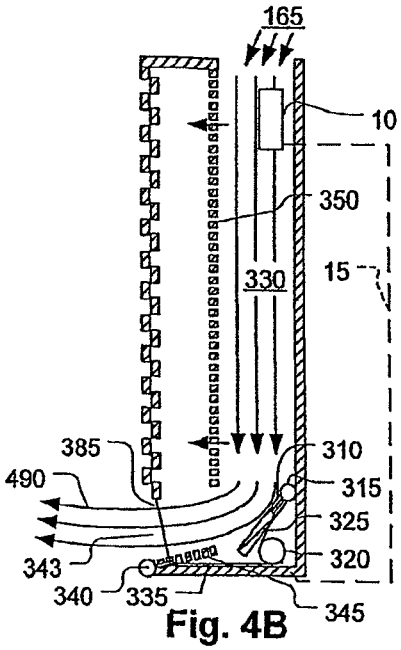

FIGS. 4A and 4B illustrate a third embodiment of a configurable mixing/displacement ventilation register 552 in displacement and mixing modes, respectively. FIG. 4A illustrates the third embodiment of the configurable mixing/displacement ventilation register 552 in the displacement, or cooling, mode. As the cool air 160 enters the ventilation register plenum 330 it causes the thermal actuator 10 to act upon the transmission 15 to rotate a spring loaded capstan 320 which releases tension on a chord 325 allowing a spring-loaded cap plate 310 to pivot on an axis of capstan-llever 315 to seal the end 312 of a plenum 330. Cool air flow 370 is forced to spread over the large face area of a flow-restricting baffle 350. The capstan 320 also releases tension on a lower pull cord 335 releasing a spring loaded baffle panel 345 to pivot on an axel 340, securing it flush with an outer baffle 304 of the configurable mixing/displacement ventilation register 552. The releasing of the spring loaded baffle panel 345 also releases tension on a third pull chord 345 allowing a sliding baffle panel 306 to align with the outer baffle 304 allowing a cool air flow 370 flow through the large face area of the two baffle panels 304 and 306 which combine to form a single open baffle or grate 322A.

The resulting configuration illustrated in FIG. 4A allows the cool air 160 to flow through the baffle/grate 322A of the configurable mixing/displacement ventilation register 552 in the manner of a displacement supply register. The open area of the baffle/grate 322 may be such as to cause substantial or little resistance across the face of the baffle/grate 322. The spreading of the flow may be provided by the inner baffle 350 or the outer baffle/grate 322 may assist by providing some resistance as well. By spreading the flow broadly over the face area of the configurable mixing/displacement ventilation register 552 as indicated by the arrows 365, it functions as displacement supply register.

FIG. 4B illustrates the third embodiment of the configurable mixing/displacement ventilation register 552 in mixing, or heating, mode. As the heated air 165 enters the ventilation register plenum 330, it causes the thermal actuator 10 to act upon the transmission 15 to rotate the spring loaded capstan 320 causing it to exert tension on the cap plate pull cord 325. This causes the spring-loaded cap plate 310 to pivot on the axel 315 and open the end of the plenum 330. The capstan 320 also exerts tension on the lower pull cord 335 causing the spring loaded baffle panel 345 to pivot on the axis 340, opening the lower portion of the configurable mixing/displacement ventilation register 552. The pivoting of the spring loaded baffle panel 345 also removes tension on the third pull chord 345 allowing the sliding baffle panel 306 to close the baffle/shutter 322 preventing the warm air flow 330 from passing through it. The heated air 165 thus passes at a relatively high velocity out the lower, relatively small face area of an open outlet 343 of the configurable mixing/displacement ventilation register 552 so that the configurable mixing/displacement ventilation register 552 functions as a mixing supply register.

Figure 5A:
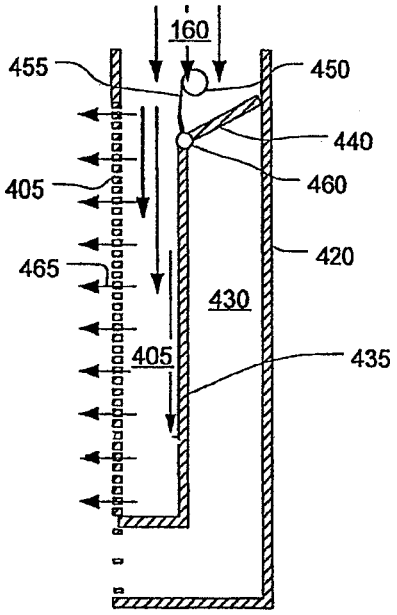
FIGS. 5A and 5B illustrate a fourth embodiment of a configurable mixing/displacement ventilation register in displacement and mixing modes, respectively.
Figure 5B:
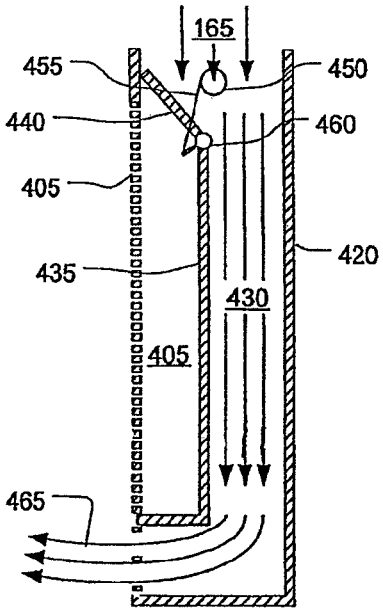

FIGS. 5A and 5B illustrate a fourth embodiment of a configurable mixing/displacement ventilation register 553 in displacement and mixing modes, respectively. FIG. 5A illustrates the displacement, or cooling mode. As the cool air 160 enters a ventilation register plenum 425 it causes a rotating a thermal actuator capstan 450 to act upon a pull chord 455 to rotate a spring loaded flap cover 440 on a pivot 460 to seal off plenum 430. This action causes the cooled air 160 to enter only a cooling plenum 405 which is separated from a heating plenum 430 by a middle wall 435. The open area of the baffle 404 is such as to cause resistance across the face of the baffle 404 thereby spreading the flow 160 broadly over the large face area of the configurable mixing/displacement ventilation register 553. This causes it to function as a displacement supply register venting air at a low velocity over a large area.

FIG. 5B illustrates the fourth embodiment of the configurable mixing/displacement ventilation register 553 in mixing, or heating, mode. As the warm air 165 enters the ventilation register plenum 425 it causes the rotating thermal actuator capstan 450 to act upon the pull chord 455 to rotate the spring loaded flap cover 440 on the pivot 460 to seal off the cooling plenum 405. This action causes the warm air 165 to enter only the warm plenum 430 which is bound by the middle wall 435 and a back wall 420. The relatively smaller face area of a heating mode outlet 475 builds greater back pressure within the warm (heating) plenum 430 causing the flow 160 to exit through the small face area of the outlet 475 of the configurable mixing/displacement ventilation register 553 at high velocity. As a result, the register 553 functions as a mixing supply register.

Figure 6A:
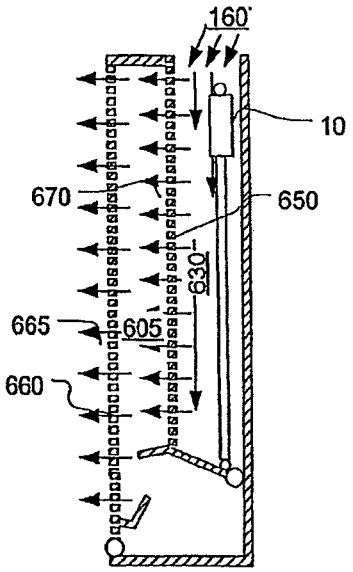
FIGS. 6A and 6B illustrate a fifth embodiment of a configurable mixing/displacement ventilation register in displacement and mixing modes, respectively.
Figure 6B:
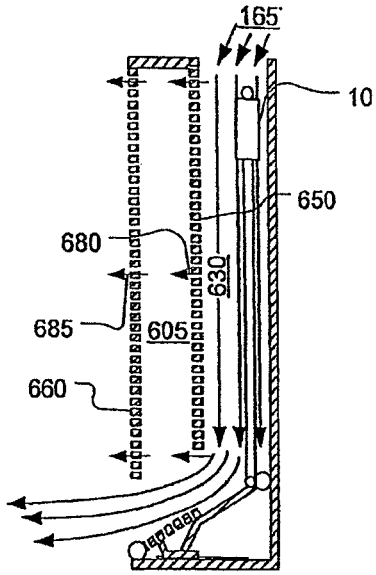

FIGS. 6A and 6B illustrate a fifth embodiment of a configurable mixing/displacement ventilation register 554 in displacement and mixing modes, respectively. FIG. 6A illustrates the fifth embodiment in displacement, or cooling, mode. As the cool air 160 enters a ventilation register a plenum 630 it causes the thermal actuator 10 to act upon a push rod 620 to rotate a cap plate 610 on a pivot 615 to seal the end of the plenum 630. Cool air flow 665 is forced to spread over the large face area of a flow-restricting inner baffle 650 and into a cooling plenum 605. The movement of the cap plate 610 also releases tension on a lower baffle panel 645 to pivot on an axel 640, securing it flush with an outer baffle 604 which forces a cool air flow 665 to spread over the large face area of a flow-restricting baffle 604.

The resulting configuration illustrated in FIG. 6A allows the cool air 630 to flow through the flow-restricting inner baffle 650 then an outer baffle 604 of the configurable mixing/displacement ventilation register 554 in the manner of a displacement supply register. The open area of the baffle 604 is such as to cause resistance across the face of the baffle 604 and lower baffle panel 645 thereby spreading the flow 665 broadly over the face area of the configurable mixing/displacement ventilation register 554 as indicated by the arrows 665 and therefore functions as displacement supply register venting air at a low velocity through relatively restrictive openings within the outer baffles 604 and the baffle panel 645.

FIG. 6B illustrates the fifth embodiment of the configurable mixing/displacement ventilation register 554 in mixing, or heating mode. As the heated air 165 enters the ventilation register plenum 630 it causes the thermal actuator 10 to act upon the push rod 620 to rotate the cap plate 610 on the pivot 615 to open the end of the plenum 630. This causes engagement of the cap plate 610 and a lever arm 655 of the baffle panel 645 to swing the baffle panel 645 in an open position, opening the lower portion of the configurable mixing/displacement ventilation register 554. As a result, the heated air 165 passes at a relatively high velocity out the lower, relatively small face area of an open outlet 643 of the configurable mixing/displacement ventilation register 554 so that it functions as a mixing supply register.

Figure 7A:
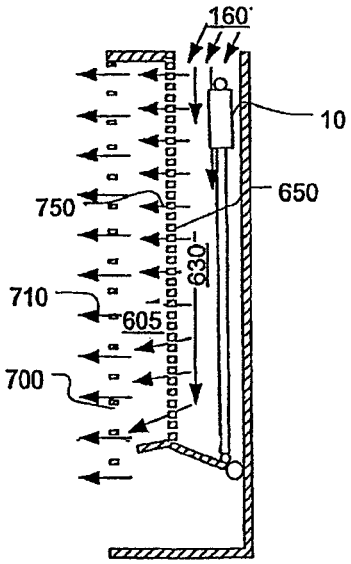
FIGS. 7 A and 7B illustrate a sixth embodiment of a configurable mixing/displacement ventilation register in displacement and mixing modes, respectively.

FIGS. 7 A and 7B illustrate a sixth embodiment of a configurable mixing/displacement ventilation register in displacement and mixing modes, respectively. FIG. 7 A illustrates the sixth embodiment in displacement, or cooling, mode. Note the present embodiment is similar to the embodiment of FIGS. 6A and 6B so many of the reference numerals are common. As the cool air 160 enters the ventilation register plenum 630 it causes the thermal actuator 10 to act upon the push rod 620 to rotate the cap plate 610 on the pivot 615 to seal the end of the plenum 630. The cool air flow 160 is forced to spread over the large face area of the flow-restricting inner baffle 650 and into the cooling plenum 605. The resulting configuration illustrated in FIG. 7 A allows the cool air 630 to flow through the flow-restricting inner baffle 650 then the very open outer baffle 700 of the configurable mixing/displacement ventilation register 555 in the manner of a displacement supply register. The resistance across the face of the baffle 650 is such as to cause resistance across the face of the baffle 650 thereby spreading the flow 750 broadly over the face area of the baffle 650 and out through the low restriction baffle 700 as indicated by the arrows 710 and therefore functions as displacement supply register venting air at a low velocity through relatively restrictive openings within the inner baffles 650 and the open baffle panel 700.

Figure 7B:
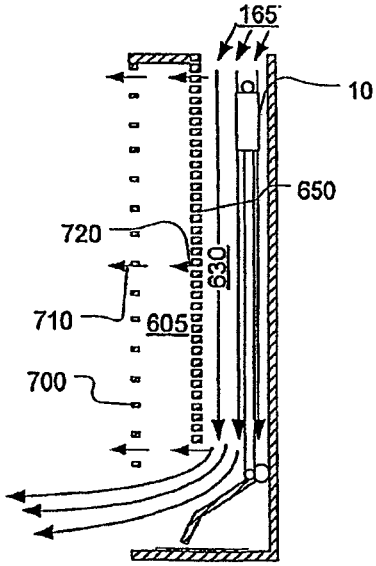

FIG. 7B illustrates the sixth embodiment of the configurable mixing/displacement ventilation register 555 in mixing, or heating mode. As the heated air 165 enters the ventilation register plenum 630 it causes the thermal actuator 10 to act upon the push rod 620 to rotate the cap plate 610 on the pivot 615 to open the end of the plenum 630. The heated air 165 thus predominately passes at a relatively high velocity out the lower, relatively small face area of an open outlet 643 of the configurable mixing/displacement ventilation register 555 so that it functions as a mixing supply register.

Figure 8A:
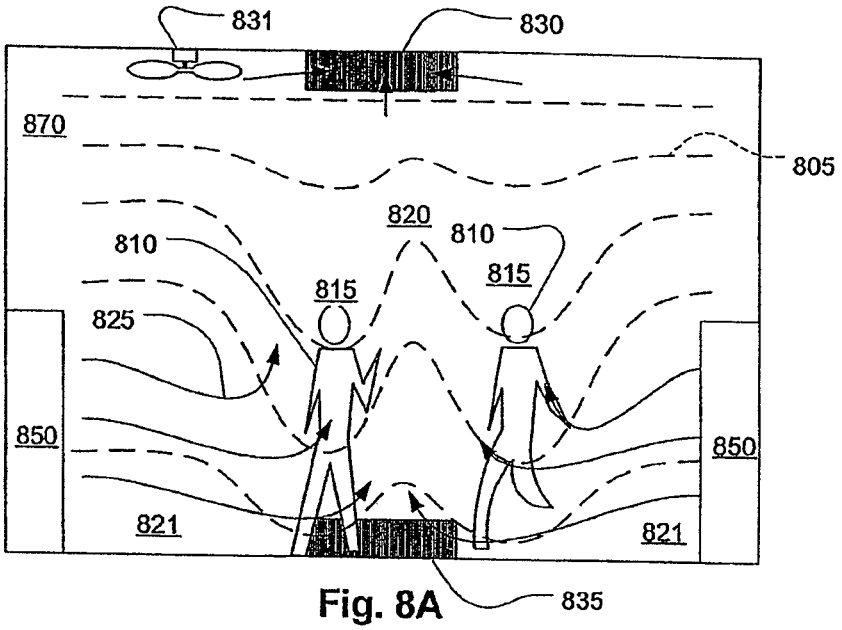
FIGS. 8A and 8B illustrate an alternative embodiment in which the return registers are changed over from heating to cooling mode, but the supply registers are the same.
Figure 8B:
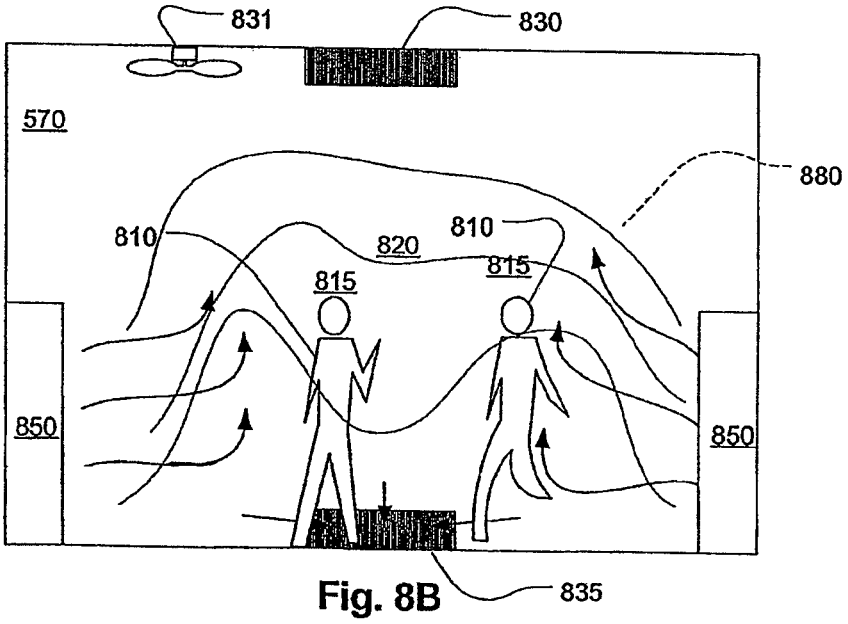

FIGS. 8A and 8B illustrate an alternative embodiment in which the return registers are changed over from heating to cooling mode, but the supply registers are in the same configuration in both heating and cooling mode. Displacement registers 850 are located in a room 850. Displacement registers 850 are normal displacement registers installed in a system in which return air registers 830 and 835 exist. During cooling mode, the displacement registers 850 deliver cool air at floor level as illustrated and warm air stratified near the ceiling is returned via return registers 830. As in previous embodiments, displacement supply air flow near the floor 821 and is heated by occupants 810 causing thermal plumes 815 which are indicated by isothermal lines 805. Warm air 870 near the ceiling is drawn into the return air register and 830. An air recirculating fan 831, may optionally be provided to mix warm stratified air in the heating mode. The fan 831 may positioned at any point in a room including near the floor or in the middle. Note that where mixing is used, return registers at only one level may suffice, for example, only one set of return registers may be used such as those near the ceiling 830 or ones located at an intermediate height (not illustrated). The circulating fan 831 may be controlled locally using a sensor for detecting either cold temperatures near the floor, warm air near the ceiling, or a floor-ceiling differential temperature.

FIG. 8B illustrates the alternative embodiment of the conventional displacement ventilation register 850 in a heating mode. Heated air enters the room 820 at low velocity and rises. A return register located near the floor draws cooled air in. By arranging the return registers at a position remote from the displacement registers 850, a circulation pattern can be established in the room that mitigates the undesirable stratification that can occur when using non-mixing type supply registers during heating.

Figure 9A:
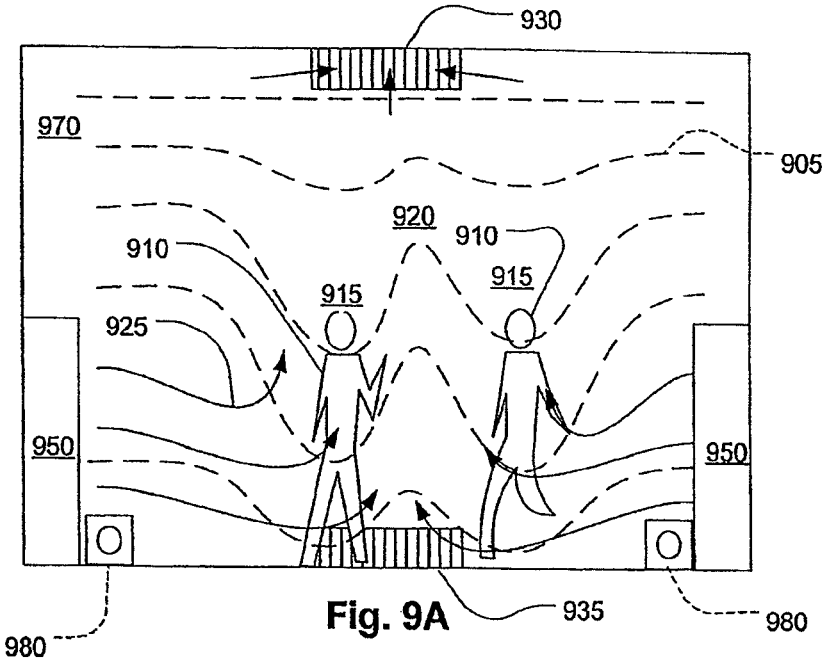
FIGS. 9A and 9B illustrate an alternative embodiment in which the return registers are changed over from heating to cooling mode, and hydronic heating is used in place of force air heating.
Figure 9B:
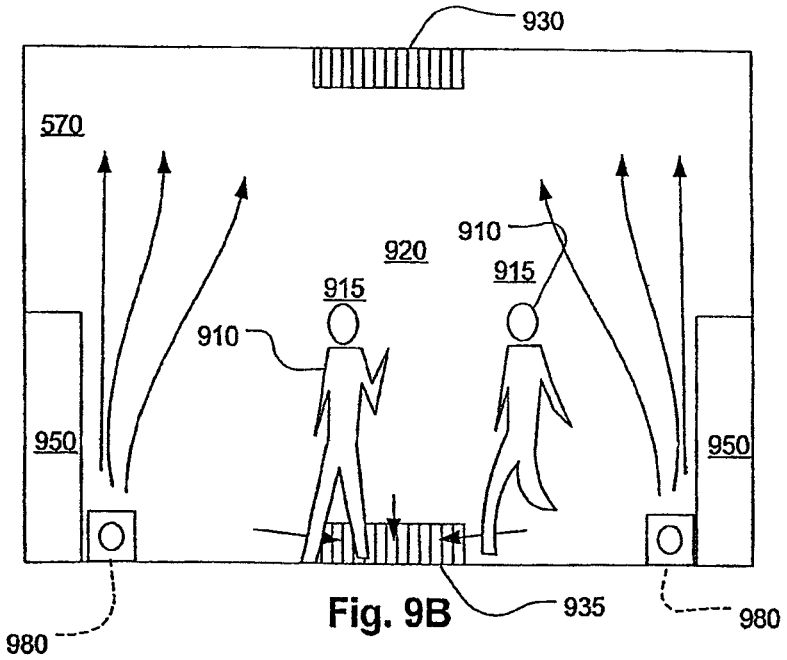

FIGS. 9A and 9B illustrate an alternative embodiment in which the return registers are changed over from heating to cooling mode, and hydronic heating is used in place of force air heating. In the present embodiment, heating is done with a separate heating system under common control, for example hydronic heating using hydronic heaters 980. Displacement registers 950 are normal displacement registers installed in a system in which return air registers 930 and 935 exist. During cooling mode, the displacement registers 950 deliver cool air at floor level as illustrated and warm air stratified near the ceiling is returned via return registers 930. As in previous embodiments, displacement supply air flow near the floor and is heated by occupants 915. Warm air 970 near the ceiling is drawn into the return air register and 930.

FIG. 9B illustrates the alternative embodiment of the conventional displacement ventilation register 850 in a heating mode. Heated air enters the room from hydronic heaters. A return register 935 located near the floor draws cooled air in. By arranging the return registers at a position remote from the hydronic heaters 980, a circulation pattern can be established in the room that mitigates the undesirable stratification that can occur when using non-mixing type supply registers during heating.

In many commercial buildings, heat may be lost through only one or two walls of an occupied space. For example, in an office building this is commonly the case. In a preferred embodiment of the general FIG. 9B embodiment, the rear wall in which at least one of the return registers 935 is located corresponds to that wall. This is so that the coldest air, which may be flowing downwardly along the surface of the "cold" wall, can be drawn into the one or more return registers 935 rather than mixing with the room air or causing the lower stratum of the room to get colder. The volume exchange rate may be sized to match the volume rate of the convective flow, which is readily predicted based on the outdoor air temperature, the conductivity and diffusivity of the wall, the film coefficients and so on according to known techniques. This is an excellent application for feed-forward or predictive model-based control because of the unsteady state of the wall system. In a preferred embodiment, such a model-based control scheme may take account of outdoor wind speed and direction, in addition to the obvious one of air temperature. In addition, such preferred embodiment may take account of conditioned space occupancy and predicted activity levels (for example, a lookup table based on time of day) so that activity-induced disturbances in the thermal convection field can be taken into account.

Obviously, a feed-forward scheme would not necessarily explicitly perform all such computations, for example, modeling the real-time temperature of the wall resulting from internal capacity and so on. But any control system controlling air exchanges based on the thermal flow from a cold wall would~end to exchange more air when it is colder outside than when it is less cold. This makes the air changes independent of the load, which for a given outdoor temperature (and possibly other conditions, as discussed), may vary depending on the activity level, which can add additional heat generation to the system (e.g. office machinery, lights, etc.). In addition, many commercial building heating systems do not alter the air exchange rate in response to load, but instead alter the delivery temperature. So a system configured to withdraw the air near a cold wall at a sufficient rate to keep the cold wall-plume from mixing well with room air would provide a volume flow rate that is higher when the load is higher (outdoor air is colder). In addition, the rates would tend to be higher, at times, than the minimum air change criteria (for ventilation purposes) would require.

A simple way of providing the additional level of control for ameliorating the effect of cold wall convection is to place temperature sensors on the cold walls or at the level of the floor near the cold wall or walls.

In many cases, the cold wall is the outside wall and may be fitted with a window. This may make the placement of the return register in the middle of the wall difficult. However, one or more return registers 935 may be located at the ends of the cold wall on one or both adjacent perpendicular walls such that air is drawn from the same lower region of the cold wall.

Figure 10:
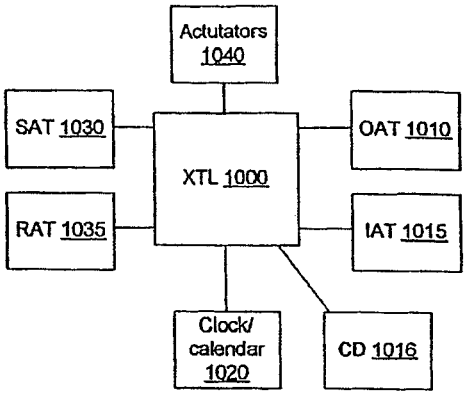
FIG. 10 is an illustration of a central control system that may be used with various embodiments discusser herein.

The effect of providing substantial air changes in a space where non-mixing is provided is to push cold air near the floor out of the room so that warm air, which tends to stratify, can be pushed down toward the floor. If the flow rate is insufficient, the floor may remain cold (and therefore uncomfortable), continually replenished by a cold convective flow from the cold wall (or walls). Note that a beneficial side effect of this tradeoff of using displacement registers in heating mode is that the system, by avoiding mixing, may reduce the risk of injury due to contaminants in a space. In this case, consider that the general forced-convective flow is down toward the floor and out the return register. Referring to FIG. 10, in a central space conditioning system, one or more contaminant detectors 1016 may be located in a return air duct and the system shut down if dangerous contaminants are detected before such contaminants could be distributed in a building. Examples of detectable contaminants increase all the time due to enhancements in sensor technology, but examples include carbon monoxide, volatile organics, opacity, and particulate counts.

In many commercial buildings, heat may be lost through only one or two walls of an occupied space. For example, in an office building this is commonly the case. In a preferred embodiment of the general FIG. 9B embodiment, the rear wall in which at least one of the return registers 935 is located corresponds to that wall. This is so that the coldest air, which may be flowing downwardly along the surface of the "cold" wall, can be drawn into the one or more return registers 935 rather than mixing with the room air or causing the lower stratum of the room to get colder. The volume exchange rate may be sized to match the volume rate of the convective flow, which is readily predicted based on the outdoor air temperature, the conductivity and diffusivity of the wall, the film coefficients and so on according to known techniques. This is an excellent application for feedward or predictive model-based control because of the unsteady state of the wall system. In a preferred embodiment, such a model-based control scheme would take account of outdoor wind speed and direction, in addition to the obvious one of air temperature. In addition, such preferred embodiment may take account of conditioned space occupancy and predicted activity levels (for example, a lookup table based on time of day) so that activity-induced disturbances in the thermal convection field can be taken into account In many cases, the cold wall is the outside wall and may be fitted with a window. This may make the placement of the return register in the middle of the wall difficult. However, one or more return registers 935 may be located at the ends of the cold wall on one or both adjacent perpendicular walls such that air is drawn from the same lower region of the cold wall.

FIG. 10 is an illustration of a central control system that may be used with various embodiments discussed herein. A programmable controller 1000 is connected to various sensors such as outdoor air temperature 1010, indoor air temperature 1015, supply air temperature 1030, and return air temperature 1035. The controller 1000 is also connected to a clock/calendar 1020 and various actuators for controlling the mechanical state of a space conditioning system including the actuators of the described multimode displacement registers, separate heating and cooling systems, and other mechanical elements described above.

Figure 11:
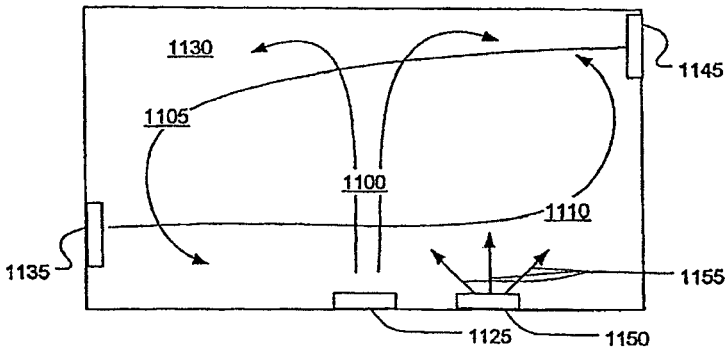
FIG. 11 shows a plan view of a room with multiple discharge registers 1125, 1135, and 1145.
Figure 12A:
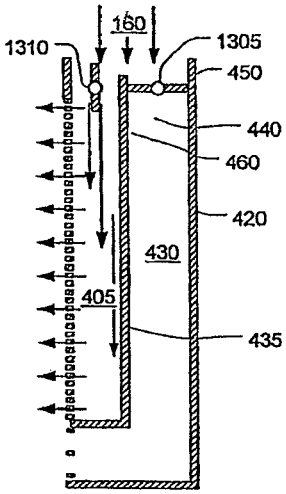
FIGS. 12A and 12B show an embodiment of a configurable mixing/displacement ventilation register in displacement and mixing modes, respectively, in which independent dampers are used to modulate total air volume, for example based on a V A V scheme.
Figure 12B:
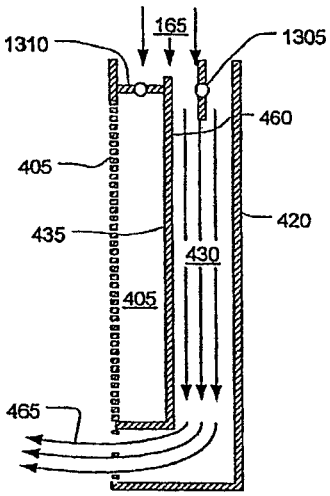
Figure 13:
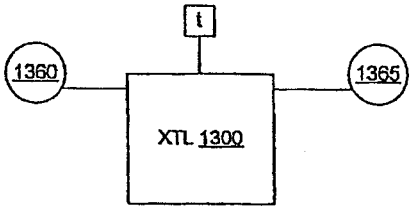
FIG. 13 illustrates a simple example of a controller for V A V control as well as mode switching for a configurable mixing/displacement ventilation register such as illustrated at FIGS. 12A and 12B.

FIG. 11 shows a plan view of a room with multiple discharge registers 1125, 1135, and 1145. The discharge pattern of each of the registers 1125, 1135, and 1145, used individually, is shown at 1100, 1105, and 1110, respectively. In an embodiment of the invention, to increase mixing with a given volume flow rate and eliminate dead spots, a single supply volume is differentially applied to a number of different registers 1125, 1135, and 1145 with the majority of the flow being output by a subset of all the different registers 1125, 1135, and 1145 at any given time. Thus, for a given flow volume, the discharge velocity at any given time will be higher than if the same flow volume were distributed more uniformly to all registers 1125, 1135, and 1145. The above may be accomplished with any kind of register equipped with a flow-volume adjusting capability. The flow pattern may be shifted, for example, on a time-basis such that all flow is supplied to register 1125 for a period of a minute, then to register 1135 for a minute, and finally to register 1145 for a minute, then repeating and so on. The cycle of shifting can be varied to change faster or slower. Note that in the above embodiment, registers 1125, 1135, and 1145 may be configurable mixing/displacement ventilation registers according to any of the embodiments described herein. In one embodiment of the invention, flow may be cycled among the registers as described above, but only in the beating mode where a high velocity mixing effect is used whilst in a cooling mode, all registers are used since displacement ventilation is employed for cooling.

In an alternative embodiment, a single register 1150 has multiple outlets, each aimed in different directions as indicated by arrows 1155. The flow is directed to each outlet in turn in a cycling pattern such that most of the supply flow is directed a single direction and then shifted to the next direction in turn. This creates varying flow patterns. The latter may be accomplished using a ventilation register device with an internal flow director such that only one inlet connection needs to be made to the supply ductwork.

Figure 14:
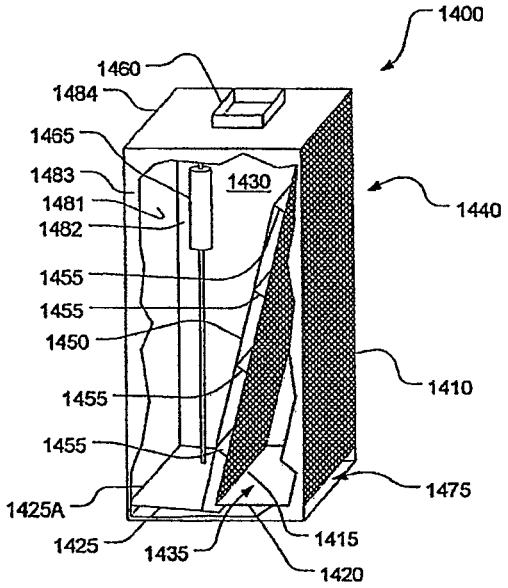
FIG. 14 illustrates seventh embodiment of a configurable mixing/displacement ventilation register.

Referring now to FIG. 14, a configurable mixing/displacement ventilation register 1400 has an internal plenum space 1430 defined by top, 1484, rear 1 48 1, and side 1482 and 1483 panels and a tilted baffle plate 1415 toward a front 1440. Air is supplied to the internal plenum space 1430 through an inlet collar 1460 that is attachable to an external duct system. A movable bottom plate 1425 is hinged at an edge 1425A thereof. The bottom plate 1425 is shown in an intermediate position between a heating mode, in which the bottom plate 1425 drops down allowing air in the plenum space 1430 to exit through a slot 1475 and a cooling mode in which the bottom plate 1425 is in a raised position forcing all air through the tilted baffle panel 1415. The slot is partly defined by a horizontal plate 1420. The bottom plate 1425 may be actuated by, for example, by a mechanical actuator 1465 which may be a thermal motor, for example, or an actuator controlled by an external or internal control mechanism (not shown in the present drawing).

In the cooling mode, air flows into the plenum space 1430 and is forced through the tilted baffle panel 1415 and then through a front baffle panel 1410. Little or no air escapes through the slot 1475 because, in the cooling mode, the bottom plate 1425 is in the up, or closed, position, thereby separating the plenum space 1430 from the slot 1475. The angle of the tilted baffle panel 141 5 makes the plenum-space 1430 progressively narrower toward the end of the plenum space 1430 that is remote from the inlet collar 1460. This helps to make the flow through the tilted baffle panel 1415 uniform along its face. Air then exits the configurable mixing/displacement ventilation register 1400 through the front baffle panel 1410 bypassing through the gap 1435. The size of the front baffle panel 1410 is relatively large and the average velocity through the front baffle panel 1410 is relatively low consistent with the function of a displacement-type register.

The configurable mixing/displacement ventilation register 1400 is preferably located adjacent or near a floor. In the heating mode, the bottom plate 1425 drops down allowing air to escape from the plenum space 1430 into the slot 1475 and out. Although some air will still escape the plenum space 1430 by flowing through the tilted baffle panel 1415 and then through the front baffle panel 1410, much of it also escapes through the slot 1475. The configuration overall may be designed such that the flow through the slot 1475 in the heating mode is relatively high, consistent with mixing-type ventilation.

This causes heated air to be projected (along the floor, in applications where the configurable mixing/displacement ventilation register 1400 is located adjacent or near the floor) well into the ventilated space. The velocity through the slot 1475 may be such that warm air from the front baffle panel 141 0 is induced into the flow from the slot 1475.

According to an optional feature of the FIG. 14 embodiment, one or more flow deflector plates 1455 may be provided to deflect flow through the tilted baffle panel 1415 in the cooling mode. In the heating mode, the flow deflector plates 1455 may pivot down and against the tilted baffle panel 1415.

In the heating mode the flow deflector plates 1455 may serve to partially (or completely) block the tilted baffle panel 1415 thereby forcing more air to pass through the slot. An arm may connect the flow deflector plates 1455 to the bottom plate 1425 so that the flow deflector plates 1455 are moved in unison with the bottom plate 1425 by the actuator 1465.

Note that in various foregoing embodiments, the bottom portion, of the register remains fixed and flow is directed in a horizontal direction. By comparison, prior art multi-mode register devices, generally designed for commercial applications, direct air downwardly during a heating mode requiring the bottom to change configuration and may result in a change in overall height of the unit. According to inventive embodiments described herein, the bottom remains fixed and the space taken up by the register unit remains fixed. This is believed to be desirable in a floor-mounted register. Also, by directing high velocity flow adjacent the floor, a more persistent jet—a wall jet—may be generated as compared to a free jet which tends to lose momentum faster.

What is claimed is:

1. An occupied space ventilation system configured to perform a heating operation and a cooling operation, the system comprising:

at least one supply register with a displacement-type diffuser for providing a flow of air heated and cooled by the system in a uniform direction, flowing substantially orthogonally to the diffuser, at a non-mixing flow rate that promotes stratification of air in the occupied space;

at least one return register configured to withdraw air from said occupied space;

a control system configured to control heated air to flow through said at least one supply register at the non-mixing rate that promotes the stratification of air in the occupied space; and a mixing fan disposed in said occupied space and operative to mix the heated air supplied from the at least one supply register with air in said occupied space, wherein the control system is additionally configured to detect that the system is operating in the heating operation and control said mixing fan to circulate the heated air supplied from the at least one supply register in said occupied space only during a heating mode of the ventilation system.

2. The system as claimed in claim 1, wherein the at least one return register includes at least one first return register configured to withdraw air at a level proximate a ceiling of said occupied space and at least one second return register configured to withdraw air from said occupied space at a level near the floor thereof;

the control system being configured selectively to control the flow of air into said at least one first return register and said at least one second return register such that during cooling, the control system is for causing cooled air to be supplied through said at least one supply register at the non-mixing rate and warm air to be withdrawn through said at least one first return register, and during heating, the control system is for causing warm air to be supplied through said at least one supply register at the non-mixing rate and cool air to be withdrawn through said at least one second return register.

3. The system as claimed in claim 2, wherein said mixing fan is controlled responsively to a local temperature gradient in said occupied space.

4. The system as claimed in claim 2, wherein the control system is responsive to outdoor air temperature.

5. The system as claimed in claim 4, wherein said mixing fan is controlled responsively to a local temperature gradient in said occupied space.

6. The system as claimed in claim 1, wherein the control system is responsive to outdoor air temperature.

7. The system as claimed in claim 6, wherein said mixing fan is controlled responsively to a local temperature gradient in said occupied space.

8. The system as claimed in claim 1, wherein said mixing fan is controlled responsively to a local temperature gradient in said occupied space.

9. The system as claimed in claim 1, wherein said mixing fan hangs from a ceiling and extends into said occupied space.

10. The system as claimed in claim 1, wherein said at least one return register includes a plurality of said return registers, each said return register being at a same level in said occupied space.

11. The system as claimed in claim 1, wherein said occupied space ventilation system is operative in mutually exclusive heating and cooling modes, wherein said at least one supply register is operative, during the cooling mode, to deliver cool air at floor level of said occupied space, and wherein said at least one return register is operative, during the cooling mode, to return air.

12. The system according to claim 1, wherein the displacement-type diffuser includes a discharge baffle having an area larger than a cross-section area of a duct supplying the displacement-type diffuser.

13. The system according to claim 12, wherein the discharge baffle is perforated by a plurality of openings, and the flow of air heated and cooled by the system passes through said plurality of openings.

14. The system according to claim 1, wherein the displacement-type diffuser has no directional vanes.

* * * * *